United States Patent [19]

Fleischmann et al.

[11] 4,357,763

[45] Nov. 9, 1982

[54] SOLE ASSEMBLY FOR A SPORTS SHOE

[75] Inventors: Josef Fleischmann, Geislingen-Binsdorf; Franz Epple, Haigerloch-Stetten, both of Fed. Rep. of Germany

[73] Assignee: Sportartikelfabrik Karl Uhl GmbH, Balingen, Fed. Rep. of Germany

[21] Appl. No.: 227,481

[22] Filed: Jan. 22, 1981

[30] Foreign Application Priority Data

Feb. 1, 1980 [DE] Fed. Rep. of Germany ..... 3003631

[51] Int. Cl.[3] ..... A43C 15/00

[52] U.S. Cl. ..... 36/67 D; 36/134

[58] Field of Search ..... 36/67 D, 67 B, 134, 36/75 A; 411/520, 521, 352

[56] References Cited

U.S. PATENT DOCUMENTS 3,054,197 9/1962 Morgan et al. ..... 36/67 D
3,354,791 11/1967 Wahlmark ..... 411/520 X

FOREIGN PATENT DOCUMENTS 765016 3/1934 France ..... 36/67 D
11592 of 1910 United Kingdom ..... 36/67 D

*Primary Examiner*—Richard J. Scanlan, Jr.
*Attorney, Agent, or Firm*—Shenier & O'Connor

[57] ABSTRACT

A sports shoe has a sole assembly with cylindrical recesses which grip longitudinally slit generally cylindrical shells of slightly larger initial diameter. The projecting ends of these shells can serve as attachments for gripping elements such as studs, attached thereto for example in the same manner. Alternatively, these projecting ends can be so shaped as to constitute integral gripping elements.

7 Claims, 5 Drawing Figures

SOLE ASSEMBLY FOR A SPORTS SHOE

FIELD OF THE INVENTION

The invention relates to a sole assembly for sports shoes, such as football shoes or baseball shoes, with releasable gripping elements engaging in recesses in a sole member.

DESCRIPTION OF PRIOR ART

It is generally known to screw studs of light metal or synthetic polymer into screw-threaded bores in the sole of football shoes. A similar attachment is also usual in respect of the so-called "irons" employed with baseball shoes.

A releasable connection operating in the manner of a bayonet closure, between gripping elements (in this case spikes) and a sole member has become known for running shoes from German Published Specification No. 2,543,268.

A further manner of fixing steel spikes releasably in soles of running shoes involves inserting the spikes into holders fixed in the sole member and inserting holding pins from the side into transverse bores in the inner ends of the spikes, as described in German Published Specification No. 2,234,117.

NATURE OF THE PRESENT INVENTION

It is object of the present invention to find a simple and durable sole assembly in which gripping elements and sole member are connected together cheaply and securely.

The invention sets out to fulfil this objective by providing a sole assembly for a sports shoe comprising:

a sole member provided with a plurality of generally cylindrical recesses extending at least in part way through its thickness, from the ground-contacting surface;

at least one gripping element;

an attempt element attached to each said gripping element and comprising a generally cylindrical shell longitudinally slit from one end over at least part of its length;

said shell extending from the gripping element into one of said cylindrical recesses in said sole member;

the diameter of said cylindrical recess being slightly less than the original diameter of the cylindrical shell whereby the attachment element outer surface is pressed into frictional engagement against said recess inner surface.

Preferably, each sole member recess is a generally cylindrical aperture within a metallic insert fixed, e.g. by casting or moulding, within the sole member.

Conveniently moreover, each attachment element is engaged in a recess extending at least part way into said gripping element. One way in which this can be done is by press-fitting the attachment element into an existing gripping element recess. For example each attachment element can be formed as a cylindrical shell with a longitudinal slit throughout its whole length and be press-fitted within a slightly narrower cylindrical recess in the gripping element.

In this case, the collar may be a standardised item which is known per se and need not be produced by the manufacture of the sports shoe sole, but may be obtained commercially to simplify and reduce expense of production.

It will be convenient in such a case if the gripping element cylindrical recess is of slightly smaller diameter than the sole member recess, so that the attachment element i.e. the slit cylindrical shell stays with the gripping element when disassembled.

Another manner of engaging each attachment element within the gripping element recess is to mold the gripping element of synthetic polymer with the attachment engaged therein during molding. In such a case the end of the cylindrical shell to be located within the gripping element can be deformed from a cylindrical configuration to increase its interengagement with the molded polymer.

However, the invention is by no means limited to embodiments in which the gripping element and the attachment element are separate parts. It is also possible to constitute these elements as two portions of an integral construction. This embodiment is particularly suitable when the gripping elements involved are irons for baseball shoes.

For this purpose it is envisaged to provide a construction in which:

said attachment element portion of said integral construction comprises a cylindrical shell possessing two longitudinal slits parallel to the cylinder axis thereof and generally occupying a first plane also including said axis; and said gripping element portion of said integral construction comprises a flattened doublewalled region occupying a second plane also including said axis usually the first and second planes will be at right angles.

BRIEF DESCRIPTION OF THE DRAWINGS

The invention will now be described by way of Example with reference to the accompanying drawings, in which.

DETAILED DESCRIPTION OF THE INVENTION

Figure 2:
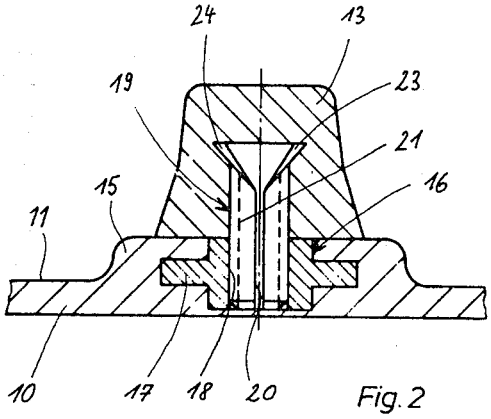
Figure 3:
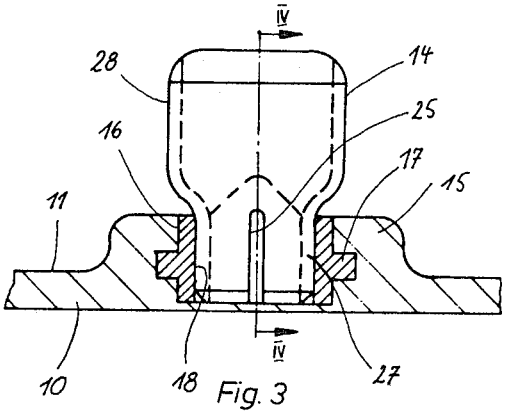
Figure 4:
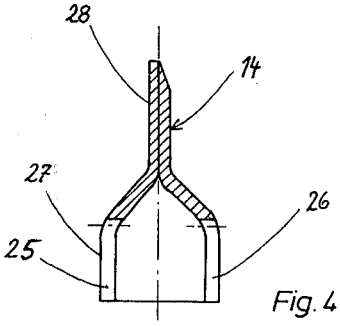
FIG. 4 shows a section on the line IV—IV in FIG. 3 with the sole omitted and FIG. 5 shows a view from above the embodiment shown in FIG. 3 with the sole likewise omitted.

FIG. 3 shows a portion of a sole member 10 of a sports shoe, e.g. a football shoe or a baseball shoe. The sole member 10 may consist of a thermoplastic synthetic polymer. On ground-contacting face 11, the sole member 10 is fitted with a plurality of gripping elements for example the football studs 12 shown in FIGS. 1 or 13 shown in FIG. 2 or the irons 14 of a baseball shoe as shown in FIG. 4.

Sole member 10 comprises a bead 15 beneath gripping elements 12, 13 or 14, the bead having a metal insert 16 cast or moulded therein and comprising a flange 17 to ensure secure retention in the sole member 10.

Each insert 16 possesses a central smooth bore 18 to hold an attachment element for the gripping element 12, 13 or 14.

Figure 1:
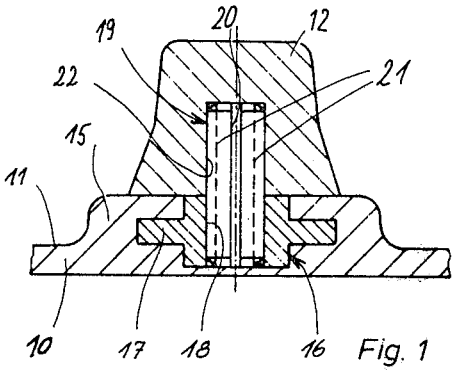
FIGS. 1 to 3 show, in longitudinal section, three different ways of fixing gripping elements in the sole of a sport shoes.

In the embodiments shown in FIGS. 1 and 2, a cylindrical shell 19 slit along one side to form a continuous longitudinal slot 20 serves as the attachment element and in the example given is a standard engineering component. The wall thickness of the collar 19 is shown by the broken lines 21.

Th gripping element 12 of FIG. 1 is a stud made for example of cast aluminium alloy. It comprises a blind recess 22 into which the end of the cylindrical shell 19 is pressed. The other end of the shell 19 is pressed into the bore 18 of the insert 16, but exerts a different gripping friction since the two recesses 18 and 22 are of slightly different diameters.

The gripping element 13 is also a stud of a football shoe and consists in this instance of synthetic polymer. The upper portion of the shell 19 in this case is embedded by casting or moulding in situ within the material of the stud 13. The upper end of the cylindrical shell 19 is opened out at 23, 24 in order to ensure secure retention in the stud 13.

Figure 5:
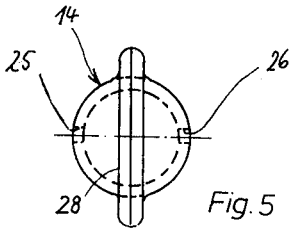

While, in the embodiments according to FIGS. 1 and 2, the gripping element and the cylindrical shell are separate components, the embodiment according to FIGS. 3–5 shows the gripping element 14 integrally constructed with the attachment elements, as a single component. A cylindrical shell portion comprises at its lower end two diametrically opposite longitudinal slots 25 and 26 occupying a common plane with the axis and thus serving to hold the component in the insert bore 18. The gripping element 14 is flattened at the portion 28 which projects beyond the holder sleeve 16 also to occupy a common plane with the axis at 90° to the first mentioned such plane and thus serves as an iron for a baseball shoe.

In FIGS. 1 to 4, the bore 18, which receives the shell 19 or 27 is shown as a cylindrical bore of uniform diameter. However, it may be enlarged at its outer end in a lightly conical manner, i.e. tapered in order to facilitate the insertion and fixing of the gripping elements 12, 13 or 14. The gripping element can be inserted manually into the bore 18 and thereafter pushed completely into its assembled position by stamping the shoe on the ground.

The following features of the invention are to be noted as a comparison with the prior art.

Studs fixed as shown may be interchanged more rapidly than screw-connected studs. Simple resilient compression of the cylindrical shell is sufficient, e.g. by means of a pair of flat pliers. Moreover, the fixing system according to the invention does not comprises screw-threads to become blocked or damaged. Also twisting the stud or iron in use does not loosen it.

Since the shell according to the invention is hollow, the total weight of the gripping element is low, and it is simple, quick and economical to produce. It is no longer necessary for the gripping element to have gripping edges (for example, have a hexagonal cross-section) and it can therefore be produced in a simple manner. Since the gripping element e.g. the stud, need not possess any more gripping edges for assembly, it can have a completely smooth surface so that considerably less dirt can adhere to the gripping element. This in turn reduces the risk off accident or injury.

If during use the gripping element should become loose the resilience of the cylindrical shell reasserts itself after relief of the load. Moreover, during the next following step by the user the gripping element can be pressed into its operative position again.

Additionally, a smooth bore can serve as a holder for the attachment element in the sole. Not only can such a bore be produced simply and economically, but also it is not sensitive to damage to use. The absence of screw threads also means that excessive tightening during the fixing is avoided with improvement in the quality of the sole assembly. Finally, should the cylindrical shell become distorted it can readily be bent back into shape.

We claim:

1. A sole assembly for a sports shoe comprising:

a sole member provided with a plurality of generally cylindrical recesses extending from the ground-contacting surface of the sole member at least part way through its thickness;

at least one gripping element having a cylindrical recess extending at least part way therewithin;

respective generally cylindrical shells longitudinally slit throughout their entire lengths and press fit into said gripping element recesses;

said shells extending from the gripping elements into respective cylindrical recesses in said sole member;

the diameter of said sole member cylindrical recesses being slightly less than the original diameter of the cylindrical shells whereby the shell outer surfaces are pressed into frictional engagement against the sole member recess inner surfaces;

the diameter of the gripping element cylindrical recesses being less than the diameter of the sole member cylindrical recesses.

2. A sole assembly as claimed in claim 1 in which each said recess is a generally cylindrical aperture within a metallic insert fixed in the sole member.

3. A sole assembly as claimed in claim 1 wherein said generally cylindrical recesses in said sole member are each slightly tapering over at least part of their length, whereby said attachment element can be more readily pressed into said recess.

4. A sole assembly for a sports shoe comprising:

a sole member provided with a plurality of generally cylindrical recesses extending at least part way through its thickness, from the ground-contacting surface;

at least one gripping element having a recess extending at least part way therewithin;

an attachment element engaging each said gripping element recess and comprising a generally cylindrical shell longitudinally slit from end over at least part of its length;

said shell extending from the gripping element into one of said cylindrical recesses in said sole member;

the diameter of said cylindrical recess being slightly less than the original diameter of the cylindrical shell whereby the attachment element outer surface is pressed into frictional engagement against said recess inner surface;

each gripping element being molded from synthetic polymeric material and the attachment element being engaged therein during molding.

5. A sole assembly as claimed in claim 4 in which an end portion of said attachment element is deformed from a cylindrical configuration to increase the interengagement with the molded synthetic polymer.

6. A sole assembly for a sports shoe comprising:

a sole member provided with a plurality of generally cylindrical recesses extending at least part way through its thickness, from the ground-contacting surface;

at least one gripping element;

an attachment element attached to each said gripping element and comprising a generally cylindrical shell longitudinally slit from end over at least part of its length;

said shell extending from the gripping element into one of said cylindrical recesses in said sole member;

the diameter of said cylindrical recess being slightly less than the original diameter of the cylindrical shell whereby the attachment element outer surface is pressed into frictional engagement against said recess inner surface;

said gripping element and said attachment element being constituted as two portions of an integral construction;

said attachment element portion of said integral construction comprising a cylindrical shell processing two longitudinal slits parallel to the cylinder axis thereof and generally occupying a first plane also including said axis; and said gripping element portion of said integral construction comprising a flattened double-walled region occupying a second plane also including said axis.

7. A sole assembly as claimed in claim 6 wherein said first plane and said second plane are at right angles.

* * * * *

UNITED STATES PATENT AND TRADEMARK OFFICE

CERTIFICATE OF CORRECTION

PATENT NO. : 4,357,763

DATED : November 9, 1982

INVENTOR(S) : Josef Fleischmann and Franz Epple

It is certified that error appears in the above-identified patent and that said Letters Patent are hereby corrected as shown below:

Column 5, line 10, "processing" should read

-- possessing --.

Signed and Sealed this

*Eleventh* Day of *January 1983*

[SEAL]

*Attest:*

GERALD J. MOSSINGHOFF

*Attesting Officer*

*Commissioner of Patents and Trademarks*